US005642142A

United States Patent [19]

Bohorquez

[11] Patent Number: 5,642,142

[45] Date of Patent: Jun. 24, 1997

[54] VARIABLE HALFTONE OPERATION INKJET PRINTHEADS

[75] Inventor: Jaime H. Bohorquez, Escondido, Calif.

[73] Assignee: Hewlett-Packard Company, Palo Alto, Calif.

[21] Appl. No.: 522,803

[22] Filed: Aug. 31, 1995

Related U.S. Application Data

[63] Continuation of Ser. No. 143,945, Oct. 26, 1993, abandoned, which is a continuation-in-part of Ser. No. 56,960, May 3, 1993, abandoned, which is a continuation-in-part of Ser. No. 983,009, Nov. 30, 1992, abandoned.

[51] Int. Cl.[6] ..... B41J 2/205

[52] U.S. Cl. ..... 347/15; 347/11

[58] Field of Search ..... 347/10, 11, 14, 347/15, 17, 41, 43; 358/298

[56] References Cited

U.S. PATENT DOCUMENTS

| | | | |
|---|---|---|---|
| 4,561,025 | 12/1985 | Tsuzuki | 358/298 |
| 4,875,059 | 10/1989 | Masuda . | |
| 4,982,199 | 1/1991 | Dunn | 347/15 |
| 5,036,337 | 7/1991 | Bohorquez | 347/14 |
| 5,146,236 | 9/1992 | Hirata et al. | 347/15 |

*Primary Examiner*—Benjamin R. Fuller
*Assistant Examiner*—L. Anderson
*Attorney, Agent, or Firm*—Dennis G. Stenstrom; Manuel Quiogue

[57] ABSTRACT

A simple and inexpensive method for halftone printing by an inkjet printer is disclosed. Improved halftone printing in an inkjet printer is provided by varying the ink drop volume of an thermal inkjet printhead by controlling the pulse width of the delivered firing pulses.

4 Claims, 6 Drawing Sheets

VARIABLE HALFTONE OPERATION INKJET PRINTHEADS

CROSS REFERENCE TO RELATED APPLICATION(S)

This is a continuation of application Ser. No. 08/143,945 filed on Oct. 26, 1993, now abandoned, which is a continuation-in-part of commonly assigned application Ser. No. 08/056,960, filed May 3, 1993, entitled CONTROL OF INK DROP VOLUME IN THERMAL INKJET PRINTHEADS BY VARYING THE PULSE WIDTH OF THE FIRING PULSES by Jaime H. Bohorquez, et al., now abandoned, which is a continuation-in-part of commonly assigned application Ser. No. 07/983,009, filed Nov. 30, 1992, entitled METHOD AND APPARATUS FOR REDUCING THE RANGE OF DROP VOLUME VARIATION IN THERMAL INK JET PRINTERS by Brian P. Canfield, et al., now abandoned, which applications are herein incorporated by reference.

FIELD OF THE INVENTION

This invention relates generally to the field of thermal inkjet printers and more particularly to controlling the ejected ink drop volume of thermal inkjet printheads.

BACKGROUND OF THE INVENTION

Thermal inkjet printers have gained wide acceptance. These printers are described by W. J. Lloyd and H. T. Taub in "Ink Jet Devices," Chapter 13 of *Output Hardcopy Devices* (Ed. R. C. Durbeck and S. Sherr, San Diego: Academic Press, 1988 ) and U.S. Pat. Nos. 4,490,728 and 4,313,684. Thermal inkjet printers produce high quality print, are compact and portable, and print quickly and quietly because only ink strikes the paper.

An inkjet printer forms a printed image by printing a pattern of individual dots at particular locations of an array defined for the printing medium. The locations are conveniently visualized as being small dots in a rectilinear array. The locations are sometimes "dot locations", "dot positions", or pixels". Thus, the printing operation can be viewed as the filling of a pattern of dot locations with dots of ink. Inkjet printers print dots by ejecting very small drops of ink onto the print medium, and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

Color thermal inkjet printers commonly employ a plurality of printheads, for example four, mounted in the print carriage to produce different colors. Each printhead contains ink of a different color, with the commonly used colors being cyan, magenta, yellow, and black. These base colors are produced by depositing a drop of the required color onto a dot location, while secondary or shaded colors are formed by depositing multiple drops of different base color inks onto the same dot location, with the overprinting of two or more base colors producing secondary colors according to well established optical principles.

The typical thermal inkier printhead (i.e., the silicon substrate, structures built on the substrate, and connections to the substrate) uses liquid ink (i.e., colorants dissolved or dispersed in a solvent). It has an array of precisely formed nozzles attached to a printhead substrate that incorporates an array of firing chambers which receive liquid ink from the ink reservoir. Each chamber has a thin-film resistor, known as a thermal inkjet firing chamber resistor, located opposite the nozzle so ink can collect between it and the nozzle. When electric printing pulses heat the thermal inkjet firing chamber resistor, a small portion of the ink next to it vaporizes and ejects a drop of ink from the printhead. Properly arranged nozzles form a dot matrix pattern. Properly sequencing the operation of each nozzle causes characters or images to be printed upon the paper as the printhead moves past the paper.

Print quality is one of the most important considerations of competition in the color inkjet printer field. Since the image output of a color inkjet printer is formed of thousands of individual ink drops, the quality of the image is ultimately dependent upon the quality of each ink drop and the arrangement of the ink drops on the print medium.

Plotters and printers that use thermal inkjet printheads are normally limited to operating in a mode that delivers a single drop volume. When printing halftone images or when a larger color gamut is required, artificial methods of simulating continuous tone printing are used such as multiple nozzles, multiple drops, pre-cursor heating, dithering and other digital halftoning methods. Most of these methods have serious drawbacks and design limitations.

Varying the drop volume can cause variations in the darkness of black-and-white text, variations in the contrast of gray-scale images, and variations in the chroma, hue, and lightness of color images. The chroma, hue, and lightness of a printed color depends on the volume of all the primary color drops that create the printed color. Controlling the drop volume improves the quality of printed text, graphics, and images.

The drop volume from an inkjet printhead can be adjusted by using the following factors: (1) the drop generation geometry (resistor physical size and exit orifice size), (2) the forces affecting the refill speed such as backpressure, filter resistance and entrance channel restrictions, (3) factors affecting the size and strength of the drive bubble such as ink temperature, the boiling surface heating rate and boiling surface cleanliness, and (4) effects on fluidic response such as the ink viscosity which is a function of the ink temperature.

The above factors can be divided into two categories: (1) factors that the printer can dynamically change and (2) factors that are fixed design parameters. Of the above factors only printhead temperature and the boiling surface heating rate (associated with the pulse width) can be dynamically adjusted by the printer.

Other methods have been used to vary the delivered ink drop volume. The first method is to vary the temperature of the printhead to change the ink viscosity and increase ejection efficiency, but this places increased stress on the printhead substrate and increases the likelihood of chemical interaction of the ink with the printhead substrate. This results in decreased chemical resistance of the printhead. The second method is to use more than one drop of ink per pixel location on the media, but this has an attendant decrease in the printer's throughput.

Thus, major advantages would be obtained if a simple and inexpensive method was available to vary the ink drop volume of an thermal inkjet printhead. These advantages include being able to produce improved halftone images in an inkjet printer.

SUMMARY OF THE INVENTION

For the reasons previously discussed, it would be advantageous to have an apparatus and a method for controlling and varying the drop volume to produce halftone printing. The foregoing and other advantages are provided by the present method for halftone printing with the same thermal inkjet printhead, which comprises the steps of selecting a first drop volume; determining a first pulse width and voltage to produce the selected first drop volume; controlling a voltage power supply to deliver said first pulse width and voltage; delivering the said first voltage and pulse width to the printhead during a first printing; selecting a second drop volume; determining a second pulse width and voltage to produce the selected second drop volume; controlling a voltage power supply to deliver said second pulse width and voltage; and delivering the said second voltage and pulse width to the printhead during a second printing.

The present invention has the advantage of controlling the drop volume and increasing the quality of halftone printing. Another major advantage of the present invention is the simplicity of the implementation in an existing printer and existing printhead. Inkjet printers are microprocessor controlled and the additional coding required to control pulse width is minimal and thus extremely inexpensive to implement.

DETAILED DESCRIPTION OF THE INVENTION

A person skilled in the art will readily appreciate the advantages and features of the disclosed invention after reading the following detailed description in conjunction with the drawings.

Figure 1:
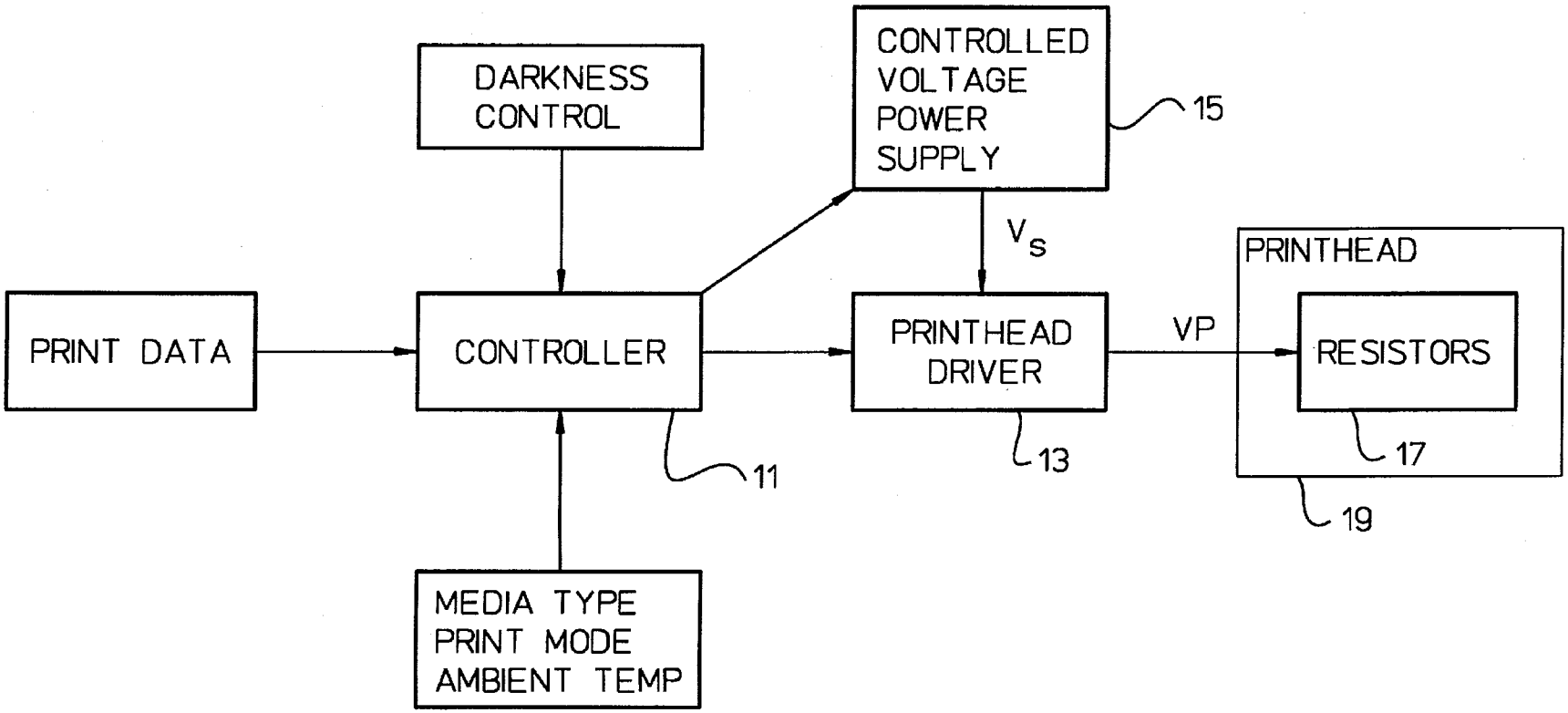
FIG. 1 is a block diagram of the present invention.

Referring to FIG. 1 there is shown a simplified block diagram of a thermal inkjet printer that employs the techniques of this invention. A controller 11 receives print data input and processes the print data to provide print control information to a printhead driver circuit 13. A controlled voltage power supply 15 provides to the printhead driver circuit 13 a controlled supply voltage $V_s$ whose magnitude is controlled by the controller 11. The printhead driver circuit 13, as controlled by the controller 11, applies driving or energizing voltage pulses of voltage $V_p$ to a thin film integrated circuit thermal inkier printhead 19 that includes thin film ink drop firing heater resistors 17.

The controller 11, which can comprise a microprocessor architecture in accordance with known controller structures, more particularly provides pulse width and pulse frequency parameters to the printhead driver circuitry 13 which produces drive voltage pulses of the width and frequency as selected by the controller, and with a voltage $V_p$ that depends on the supply voltage $V_s$ provided by the voltage controlled power supply 15 as controlled by the controller 11. Essentially, the controller 11 controls the pulse width, frequency, and voltage of the voltage pulses applied by the driver circuit to the heater resistors.

As with known controller structures, the controller 11 would typically provide other functions such as control of the printhead carriage (not shown) and control of movement of the print media. In accordance with the invention, the controller 11 determines a turn-on pulse energy for the printhead 19 that is the minimum pulse energy at which a heater resistor produces an ink drop of the proper volume, wherein pulse energy refers to the amount of energy provided by a voltage pulse; i.e., instantaneous power multiplied by pulse width.

Another aspect of the invention, is a darkness control adjustment 9, shown in FIG. 1, that allows the user to change the reference drop volume and thereby adjust the darkness of the print or the time required for the ink to dry according to personal preference or changes in the cartridge performance. A thermal inkjet printhead requires a certain minimum energy to fire ink drops of the proper volume (herein called the turn-on energy). Turn-on energy can be different for different printhead designs, and in fact varies among different samples of a given printhead design as a result of manufacturing tolerances. As a result, thermal inkjet printers are configured to provide a fixed ink firing energy that is greater than the expected highest turn-on energy for the printhead cartridges it can accommodate. This amount of excess energy beyond the turn-on energy is defined as the over-energy.

In accordance with the present over-invention, the effect of pulse width variations, at constant over energy, on turn-on energy and drop volume has been utilized to vary ink drop volumes in order to produce different dot sizes for use in different printing situations. Ink drop volumes were measured at a constant over energy that in one instance included 15 percent over energy so that (1) the shift in turn-on energy with pulse width is accounted for and (2) all ink drop volumes are at a constant over energy. The turn-on energy shift is due to the fact that shorter pulse widths heat the resistor and the ink more rapidly and efficiently, so as to lower the amount of energy necessary. Turn-on energy varies linearly with pulse widths in the range of 1.5 to 3.5 microseconds of approximately 0.05 microjoules/microseconds. Drop volume varied over this pulse width range with a slope of 5.0 picoliters/microsecond.

Figure 2:
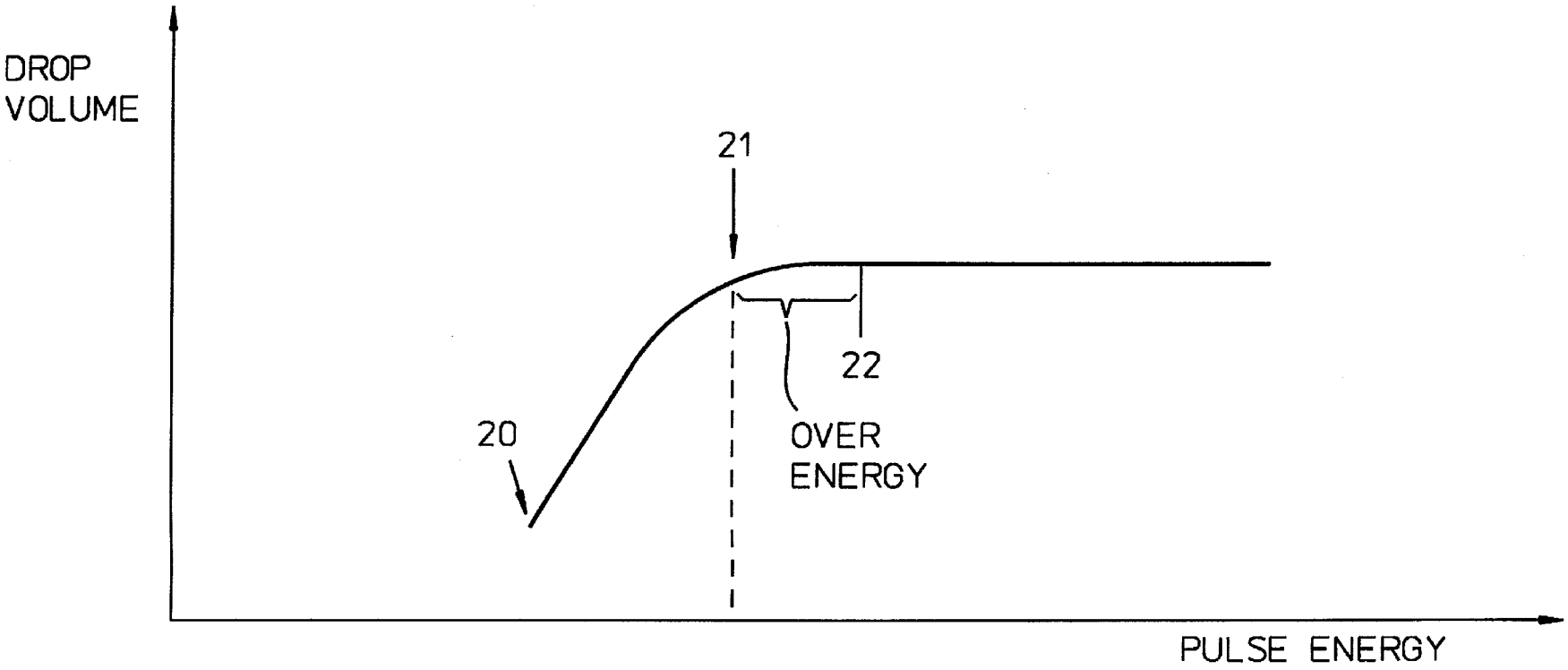
FIG. 2 is a plot of drop volume versus pulse energy for one pulse width.

The turn-on energy at any particular pulse width is determined by firing the printhead with a fixed pulse width and varying the pulse voltage $V_p$. The response of the drop volume to the range of energies tested is shown in FIG. 2 for one pulse width. Below the energy marked as the extinction energy 20, no drops are fired as the ink vaporization event does not occur. As the energy is increased from that energy increasingly larger drops are ejected until a point called the turn-on energy is reached 21. After that point adding additional energy does not increase the drop volume further and the drop generator is said to be operating in the mature energy region. The operating energy 22 is set in this mature region.

Figure 3:
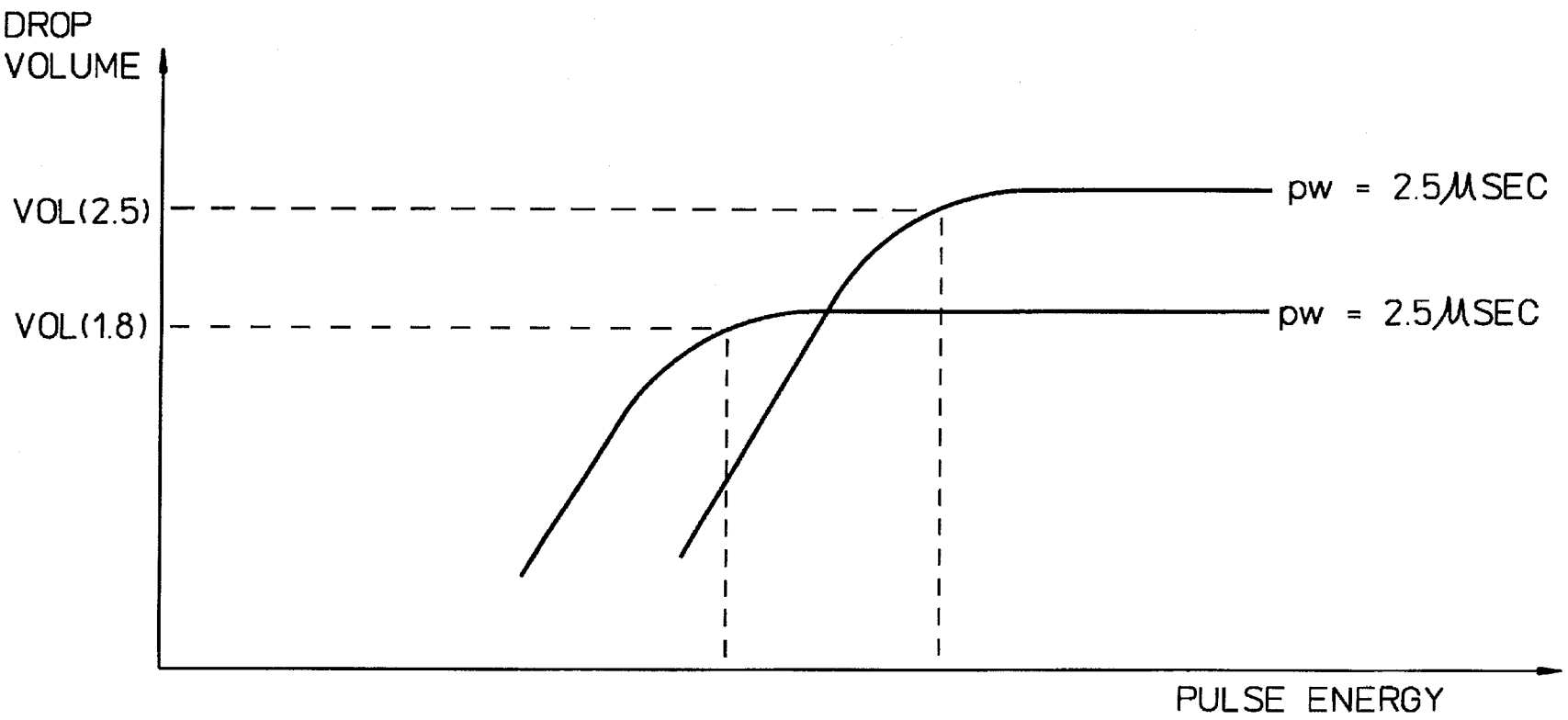
FIG. 3 is a plot of drop volume versus pulse energy for two different pulse widths.
Figure 4:
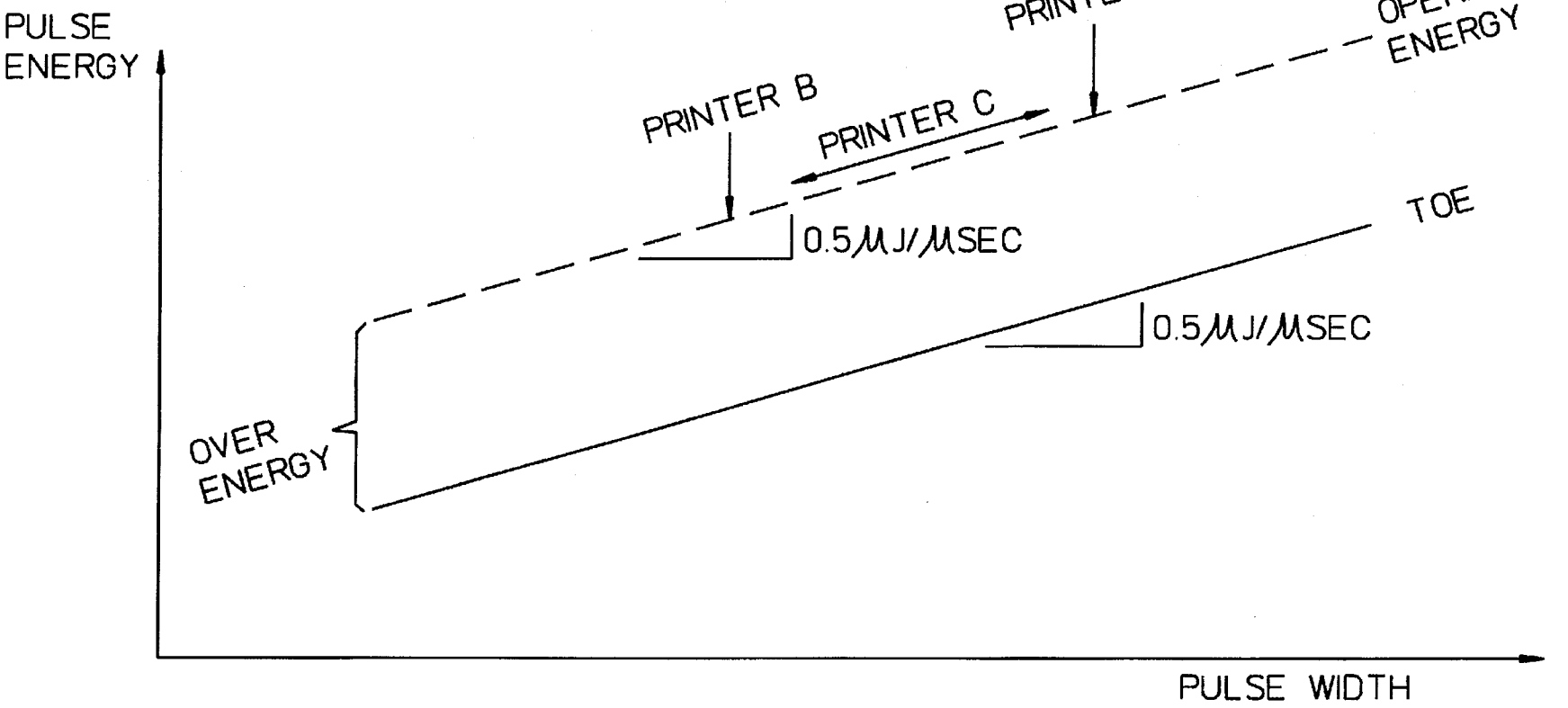
FIG. 4 is a plot of pulse energy versus pulse width.

FIG. 3 shows the response of FIG. 2 for the same ink and drop generation architecture at two different pulse widths. The turn-on energies 21 changed between the two pulse widths as does the drop volume in the mature region. This change in the mature drop volume is the effect utilized in the present invention. The change in turn-on energy 21 is accommodated by changing the operating energy 22 used between the two pulse widths at the same rate that the turn-on energy 21 changes, namely 0.5 microJoules/microsecond as shown in FIG. 4.

Figure 5:
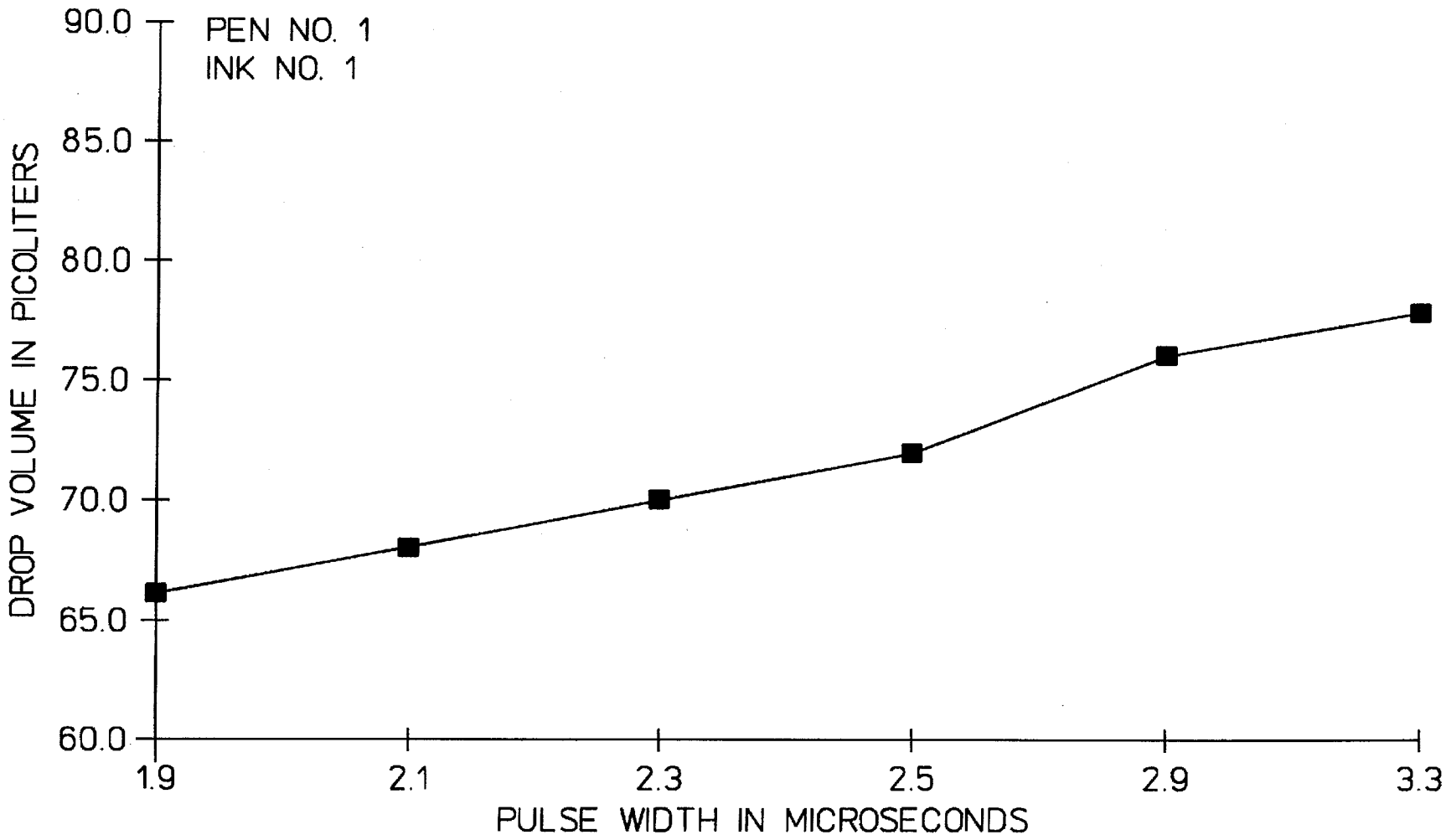
FIG. 5 shows the effect of pulse width on drop volume for a thermal inkjet printhead.

FIG. 5 shows the drop volume versus pulse width for a specific printhead and ink in accordance with the present invention. The ink is a black pigment ink with a polymer dispersant. The printhead resistor size was 45 microns. FIG. 5 demonstrates the drop volume control that can be obtained by using the present invention which varies the pulse width of the firing pulses. The method also keeps the pulse width from falling below the minimum value for acceptable reliability.

The effect of this change in the drop volume can be used by a printer to produce higher drop volumes to increase optical density or to produce lower drop volumes to reduce drying times. This also allows the printer to dynamically adjust the pulse width and the operating energy along that operating energy curve to dynamically adjust the drop volume, and thus the size of the dots placed on the media, from one sweep of the carriage to the next.

A dot is a single spot of ink printed on paper or other medium by an ink droplet. A unit ink droplet volume is the nominal drop volume selected so that a dot produced thereby approximately covers one pixel location on a given printing medium. A grid location is the finest resolution on which the printing device can place dots. For instance, a 300 dot per inch (dpi) machine prints at 1/300th-inch grid locations. According to the invention, multiple volume dots can be printed at each grid location by printing a single dot size each time the print cartridge passes over the location. The total number of dots printed at each location thus is less than or equal to the number of print passes.

Typically, a sheet of paper is printed by applying ink at the specified dot positions (pixels). The dots may be printed in single (e.g., black) or multiple colors. The columns of dots made by inkjet nozzles across a horizontal portion of the paper is sometimes called a swath. A swath may be printed by one or more passes, or sweeps, of the inkjet nozzles across the same horizontal portion, depending upon the required print mode. To print a multiple color image, the carriage may have to make more than one sweep across the print medium and make two or more drops of ink with different primary colors at the same dot locations ("pixels"), as disclosed in U.S. Pat. No. 4,855,752.

A printer usually has several different modes of printing. Each of the different modes is used to produce a different type or quality of an image. In order to reduce undesirable "banding", some of the known printing modes advance the print medium relative to the carriage in the vertical direction by only a fraction of the height of a single swath. In order to reduce "bleeding", multi-pass printing modes may be used in which the dots applied in successive passes are interleaved vertically and horizontally. Moreover, both single pass and multiple pass print modes may employ "Resolution Enhancement Technology" in which additional dots of ink are selectively applied between adjacent pixels to increase image density and/or to provide smoother boundaries for curved or diagonal images.

In addition, one or more "high quality" modes can be specified whereby density of the print dots is increased to enhance the quality of the printed images. In some printers, a "high quality" mode of printing may require the printer to make multiple passes across substantially the same horizontal portion of the page. For example, in a high quality three pass mode, a printer makes three sweeps across the page to print a single swath. In each of the three sweeps, the printer would print one of every three consecutive dots so as to allow more time for one dot to dry before the neighboring dot is printed, and thereby preventing the possibility that the ink of the two neighboring dots would combine to produce an unwanted shape or color. Such a three pass printing mode may also be used to reduce banding by dividing the swath into three reduced-height bands, printed in successive but overlapping printing cycles each providing for three passes across an associated reduced-height band.

FIG. 1 shows one implementation of the invention that could be used in current printers with minimal changes of the electronics and drive circuits. Since the print energy to the heating element has to be kept within very tight limits so as not to affect the reliability of the heating element, the voltage to the heating element is adjusted as the pulse width of the printing pulse is changed. One such method would be to adjust the voltage on a swath-by-swath basis.

In one embodiment of the invention, three different ink volumes utilized so as to provide an ink droplets having (1) "reduced" volume, (2) "nominal" drop volume and (3) an "increased" drop volume. As the carriage makes a first pass over the print media either no drop or a reduced volume drop is deposited on each pixel location, depending upon the desired image. As the carriage makes a second pass over the print media, the printer again can deposit no drop or a normal drop volume on any particular pixel location. As the carriage makes a third pass over the print media, the printer again can deposit no drop or an increased drop volume on any particular pixel location. Thus, three distinct combinations of drops are available to each pixel location using two passes: no drops, a single drop, two drops, or three drops.

This has the advantage of increasing resolution of print density by providing a choice of four levels, i.e., zero, reduced volume, unit volume, or increased volume rather than the usual binary mode. The incremental cost of implementing the higher color or gray scale resolution is modest because the printing grid resolution, e.g. 300 DPI, is retained. Thus no modification to the printer mechanics and drive means that define the printing grid is necessary to use the invention.

Figure 6:
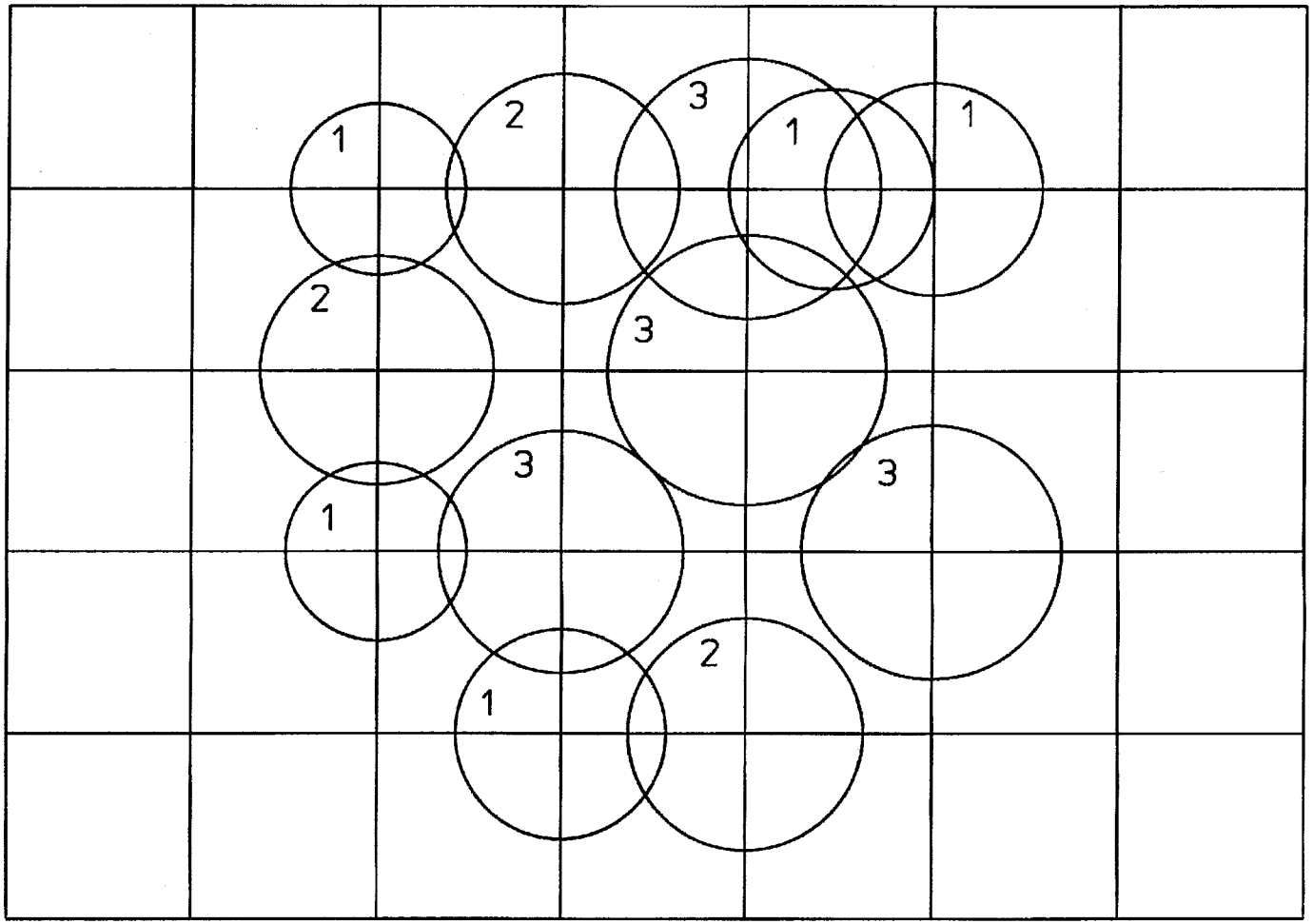
FIG. 6 shows the placement of multiple volume ink droplets.

FIG. 6 details a three dot size three pass print mode, but the invention is not limited to this print mode. Dots labeled 1 are printed during pass number one with one pulse width and voltage, dots labeled 2 are printed during pass number two with an appropriate voltage and pulse width and finally dots labeled 3 are printed during pass number three with appropriate voltage and pulse width. The effect is to print dots of three different dot sizes using a printhead without multiple nozzle sizes or colorant concentrations, therefore avoiding the throughput and ink media interactions associated with these alternate methods. This principle of the invention also includes two ink volume levels and three or more ink volume levels.

The foregoing description of the preferred embodiment of the present invention has been presented for the purposes of illustration and description. It is not intended to be exhaustive, nor to limit the invention to the precise form disclosed. Obviously many modifications and variations are possible in light of the above teachings. The embodiments where chosen in order to best explain the best mode of the invention. Thus, it is intended that the scope of the invention be defined by the claims appended hereto.

What is claimed is:

1. A method for halftone printing a predetermined pixel array with a thermal inkjet printhead, comprising the steps of:

selecting a first drop volume;

determining a first pulse width and a first operating energy to produce the selected first drop volume, said first operating energy being substantially equal to a sum of a corresponding turn-on energy for said first pulse width and a predetermined over energy;

controlling a voltage power supply to deliver said first pulse width at said first operating energy;

delivering said first pulse width at said first operating energy to the printhead during a first printing of the predetermined pixel array;

selecting a second drop volume that is different from the selected first drop volume;

determining a second pulse width and a second operating energy to produce the selected second drop volume, said second pulse width being different from said first pulse width, and said second operating energy being substantially equal to a sum of a corresponding turn-on energy for said second pulse width and said predetermined over energy;

controlling the voltage power supply to deliver said second pulse width at said second operating energy; and delivering said second pulse width at said second operating energy to the printhead during a second printing of the predetermined pixel array.

2. The method of claim 1 further including the steps of:

selecting a third drop volume that is different from the selected first drop volume and the selected second drop volume;

determining a third pulse width and a third operating energy to produce the selected third drop volume, said third pulse width being different from said first pulse width and said second pulse width, and said third operating energy being substantially equal to a sum of a corresponding turn-on energy for said third pulse width and said predetermined over energy;

controlling the voltage power supply to deliver said third pulse width at said third operating energy; and delivering said third pulse width at said third operating energy to the printhead during a third printing of the predetermined pixel array.

3. A method of halftone printing with a thermal inkjet printer having a thermal inkjet printhead, comprising the steps of:

determining a first pulse width and a first operating energy causing the thermal inkjet printhead to deposit ink drops having a first selected drop volume, said first operating energy being substantially equal to a sum of a corresponding turn-on energy for said first pulse width and a predetermined over energy;

controlling a voltage supply to provide said first pulse width at said first operating energy;

operating the thermal inkjet printhead with said first pulse width at said first operating energy to deposit on a predetermined pixel array first ink drops each having the selected first drop volume;

determining a second pulse width and a second operating energy that will cause the thermal ink jet printhead to deposit ink drops having a second selected drop volume that is different from the first selected drop volume, said second pulse width being different from said first pulse width, and said second operating energy being substantially equal to a sum of a corresponding turn-on energy for said second pulse width and said predetermined over energy;

controlling the voltage supply to provide said second pulse width at said second operating energy; and operating the thermal inkjet printhead with said second pulse width at said second operating energy to deposit on the predetermined pixel array second ink drops each having the selected second drop volume;

whereby a single thermal inkjet printhead is controlled to deposit ink drops of different drop volumes on the predetermined pixel array.

4. The method of claim 3 further including the steps of:

determining a third pulse width and a third operating energy to produce a third selected drop volume that is different from the first selected drop volume and the second selected drop volume, said third pulse width being different from said first pulse width and said second pulse width, and said third operating energy being substantially equal to a sum of a corresponding turn-on energy for said third pulse width and said predetermined over energy;

controlling the voltage supply to provide said third pulse width and said third voltage; and operating the thermal inkjet printhead with said third pulse width at said third operating energy to deposit on the predetermined pixel array third ink drops each having the selected third drop volume.

* * * * *